United States Patent [19]

Wuthrich et al.

[11] 4,023,002

[45] May 10, 1977

[54] PUSHER AND SWITCH DEVICE FOR ELECTRONIC WATCH

[75] Inventors: Paul Wuthrich, Watertown; Frank P. Mascia, Bristol, both of Conn.

[73] Assignee: Timex Corporation, Waterbury, Conn.

[22] Filed: Jan. 14, 1976

[21] Appl. No.: 649,114

[52] U.S. Cl. ..... 200/159 R; 58/23 R; 58/33; 58/34; 58/85.5; 58/90 B; 200/302; 200/340

[51] Int. Cl.[2] ..... H01H 3/12; G04C 3/00

[58] Field of Search ..... 200/52 R, 159 R, 159 A, 200/302, 340, 264; 58/23, 33, 34, 63, 73, 85.5, 90 R, 90 B

[56] References Cited

UNITED STATES PATENTS

| | | | |
|---|---|---|---|
| 3,737,605 | 6/1973 | Tobey et al. | 200/302 |
| 3,783,607 | 1/1974 | Feurer | 58/90 B |
| 3,810,354 | 5/1974 | Naikaido et al. | 58/34 X |
| 3,846,971 | 11/1974 | Ho et al. | 58/23 R |
| 3,874,162 | 1/1975 | Boxberger et al. | 58/85.5 X |
| 3,973,099 | 8/1976 | Morris, Sr. | 200/159 R |
| 3,974,351 | 8/1976 | Solov et al. | 200/159 R |

*Primary Examiner*—James R. Scott

[57] ABSTRACT

The pusher and switch device is employed in electronic watches for actuating, for example, a display light. The pusher includes a crown portion, a stem portion extending through the wall of the case and having an intermediate section on the inside of the case which cooperates with a single stamped spring to provide axial movement of the stem.

In addition to permitting axial movement of the stem, the spring arrangement also provides electrical contact to ground the stem to the case.

A sealing element or gasket is held in an annular groove formed in the stem which contacts the internal surface of the case to provide for water resistant construction.

3 Claims, 3 Drawing Figures

PUSHER AND SWITCH DEVICE FOR ELECTRONIC WATCH

BACKGROUND OF THE INVENTION

The present invention relates to a pusher and switch assembly for electronic watches.

In the use of electronic watches, particularly multifunction digital watches, it is necessary to have switches which enable the user of the watch to, for example, select the desired display function or to illuminate the display. A pusher for actuating a switch within an electronic watch is disclosed in U.S. Pat. No. 3,783,607 to Feurer, which issued Jan. 8, 1974.

Other prior art patents of interest include U.S. Pat. No. 3,874,162 to Boxberger et al, issued Apr. 1, 1975; U.S. Pat. No. 3,757,512 to Zellweger et al, issued Sept. 11, 1973; and U.S. Pat. No. 3,621, 649 to Vulcan et al, issued Nov. 23, 1971. These prior art patents are merely typical of the art showing devices to control the watch functions.

However, in contrast to the prior art, the present invention provides a pusher and switch device having a simple, robust and relatively inexpensive one-piece pusher stem structure, and a single stamped or blanked return spring affixed or held inside the watchcase under spring pressure. The pusher can readily be assembled during mass production and dismantled for cleaning and overhaul without using special tools since the assembly does not require press fittings. The spring is contoured such that the tension against the shaft, case wall and watch module provides excellent electrical connection of the shaft to the grounded case. Due to the structure of the shaft and spring assembly, the sealing grommet can have a more massive body, permitting large compression which improves the sealing qualities. And the small diameter of the pusher shank or shaft permits thinner case profile.

SUMMARY OF THE INVENTION

The present invention relates to a pusher and switch assembly for electronic watches which comprises a shaft having an intermediate spring retainer section in the portion immediately inside the case and a switch contact or tab section at the internal end of the shaft. The shaft is biased in a normally outward position and maintained in electrical contact with the spring by the cooperating action of the spring and the retainer section of the shaft. The shaft is capable of axial motion by the action of the spring when the crown is pushed in. The spring includes outwardly extending portions which are biased against the case so that a high simultaneous contact pressure is provided between the stem and spring and case.

A switch blade is positioned to be axially engaged by the switch contact portion of the shaft with inward axial motion of the shaft.

A further feature is an intermediate annular groove in the shaft between the openings in the case through which the shaft extends. A gasket element is held in the annular grove and is in contact with the case or a housing member to provide an improved seal therebetween.

Accordingly, an objective of the present invention is to provide a new and improved pusher device.

A further objective of the present invention is to provide a new and improved pusher and switch assembly.

Another objective of the present invention is to provide a pusher device having a one-piece stem and stamped spring structure.

Another objective of the present invention is to provide a new and improved pusher spring and stem assembly. cl BRIEF DESCRIPTION OF THE DRAWINGS Other objectives and advantages of the present invention will be seen from the following description when viewed in conjunction with the accompanying drawings wherein:

FIG. 1 is a plane view showing a portion of the stem assembly cooperating with the spring member in the vicinity of the watchcase according to the preferred embodiment of the present invention; and FIG. 2 is a top view of the preferred embodiment of the pusher and switch assembly according to the present invention; and FIG. 3 is a side view showing the axial biasing of the stem by the spring.

DETAILED DESCRIPTION OF THE INVENTION

Figure 1:
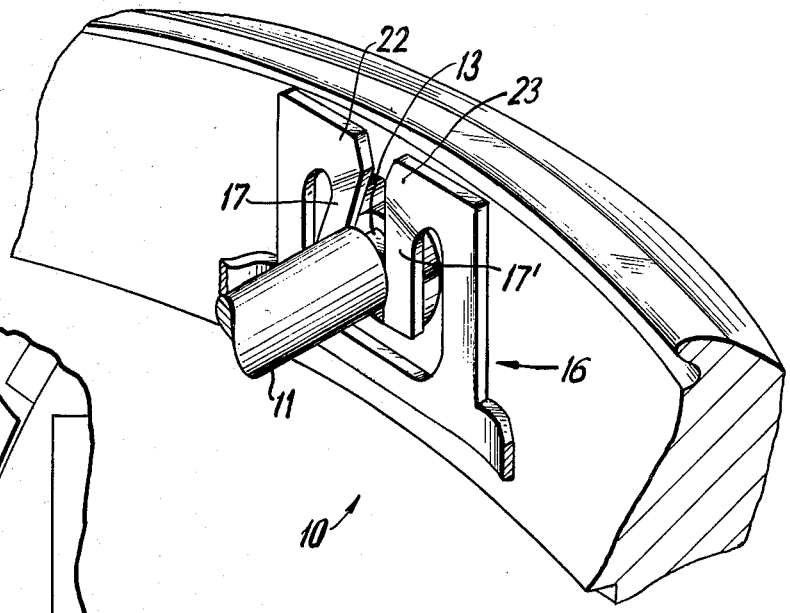
Figure 2:
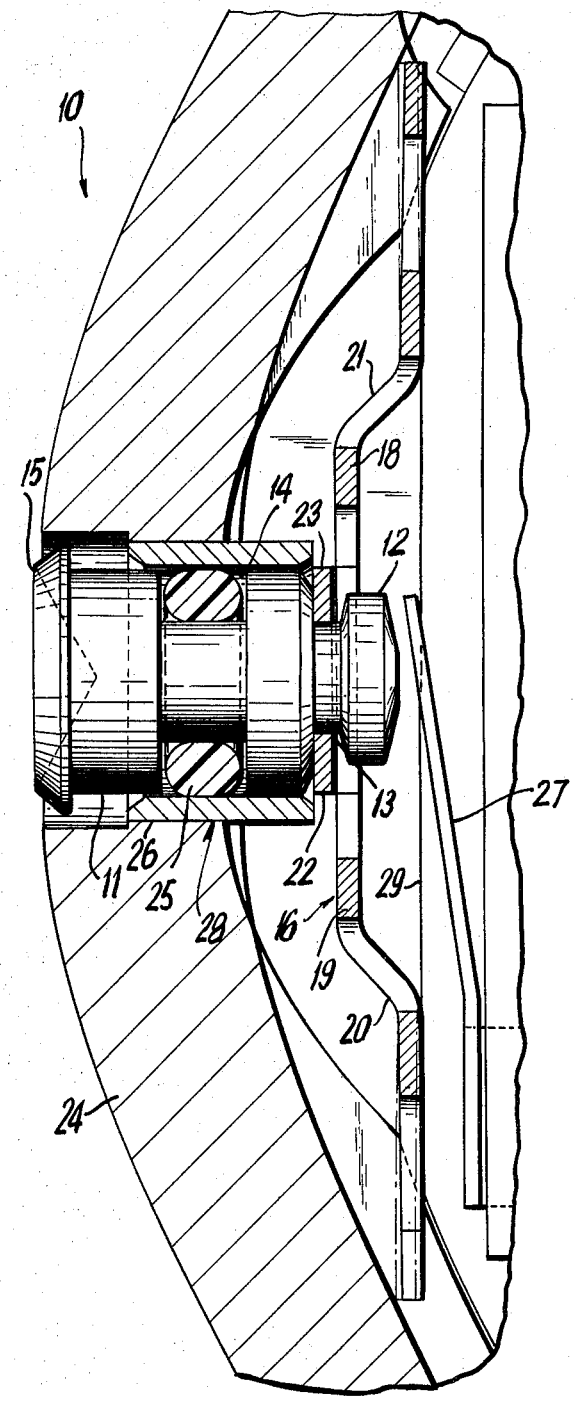

Referring to FIGS. 1 and 2 of the drawings, the invention comprises an electronic watch pusher and switch assembly 10 which includes a stem having a main shaft portion 11, a switch contact or interior end portion 12, an intermediate spring retainer or engaging section 13 of lesser diameter than the shaft 11, an annular groove 14 formed in the shaft and another end portion having a watch crown 15, and a stamped or blanked return spring 16.

The spring retainer section 13 is engaged by a single stamped spring 16 to provide spring bias to the shaft to permit axial motion of the stem and electrical contact between the shaft and the spring 16. The spring 16 comprises a pair of spaced, substantially U-shaped arms extending upwardly from the base of the spring 16. The opposing legs 22, 23 of the spring 16 are spring biased into engagement with the spring retainer section 13 and, also, spring biased and projected from the base connecting arms. The spring 16 is preformed at a point 17, 17' so as to exert not ony a high radial contact pressure between the shaft 11 and the spring arms but also an outward spring pressure or bias on the stem. The spring includes outwardly extending portions 18, 19 which are contoured 20, 21, so as to apply pressure against the case 24 and the watch substrate board or module 29 (partially shown) when properly inserted in the watch.

In this manner, the spring 16 is held in a substantially rigid position under spring pressure to enable spring biasing of the stem and electrical contact with the grounded case 24. Thus, insertion and removal of the spring 16 and stem into and out of the watch can be effected during mass production and/or repair, without the need of expensive permanent affixing of the spring, for example, by bonding or soldering to the watchcase, by simply inserting the stem into the case opening and then pushing the spring in from the bottom or top of the case to engage the stem.

During axial motion of the stem, a gasket 25 applies pressure between the annular groove 14 and the internal wall 26 of the case or against a housing member 28 to prevent dust and moisture from entering the interior of the watchcase. The sealing gasket or grommet can have a more massive body permitting large compression which improves the sealing quality between the shaft 11 and the internal wall 26 of the case since the one-piece stem structure cooperates with a spring positioned inside the case of the watch.

Figure 3:
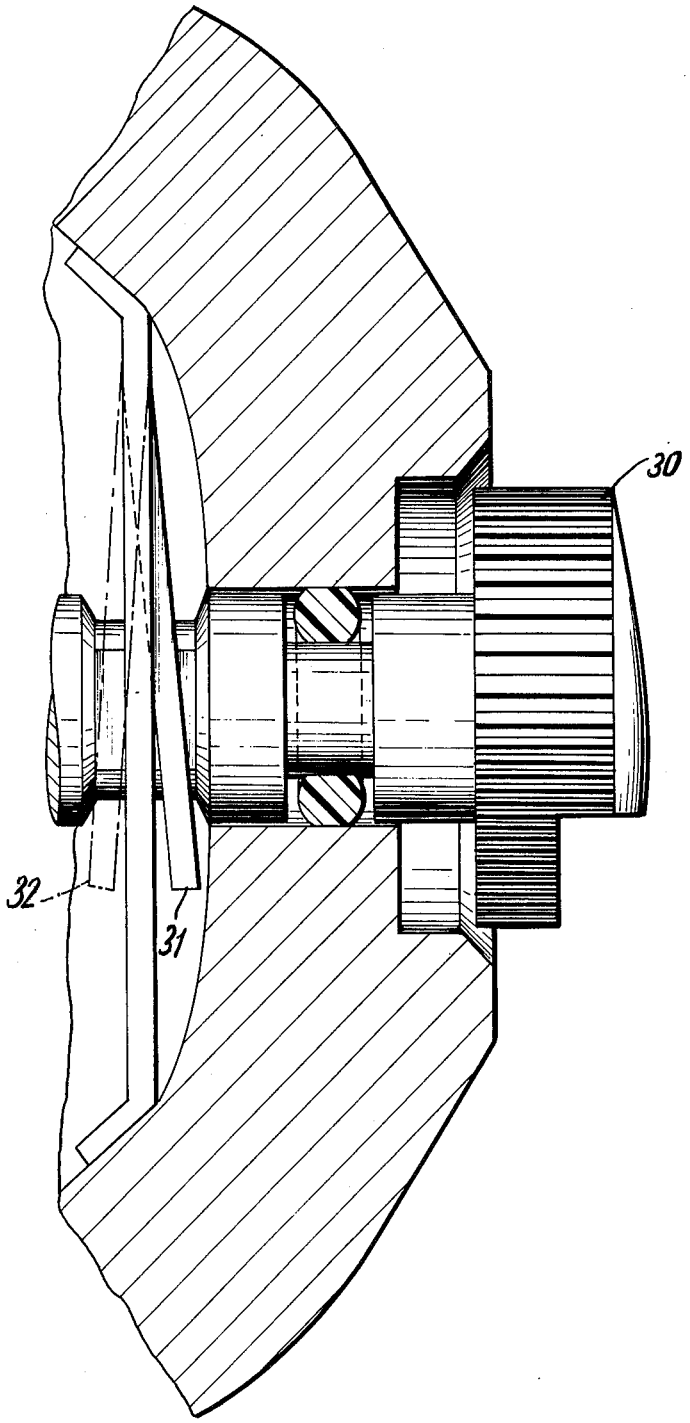

In the operation of the device as illustrated in FIG. 3, the wearer of the watch pushes in or depresses the crown 30 by applying pressure thereto. The crown 30 is pushed in against the sprng arm biases, only one is shown 31, which return the stem to its normal position upon release. During this motion of the stem, the switch contact section 12 (shown in FIG. 2) axially engages a switch blade 27, for example, a display light switch blade. The spring arms are preformed so as to permit axial motion of the stem as illustrated by the dashed line 32.

While the invention has been explained by a detailed description of the preferred embodiment, it is understood that various modifications and substitutions can be made within the scope of the appended claims which are intended also to include equivalents of the shown embodiment.

What is claimed is:

1. A pusher and switch assembly for an electronic watch having a module assembly and a case with an opening for access to the interior thereof, comprising:

a shaft movably mounted in said opening and having an interior end portion, a spring retainer section and an actuating end portion;

a switch blade mounted inside the case for axial engagement with the interior end portion of the shaft; and spring means having a pair of separately protruding substantially U-shaped arms forming an orifice to enable transverse insertion of said spring means into the case between the module assembly and the case for engaging the spring retainer section of the shaft which exerts axial bias on the shaft for providing axial motion therto and outwardly extending portions contoured for mounting the spring means inside the case by spring pressure against the case and the module assembly for providing spring bias mounting and assembly of the spring means and the shaft.

2. A pusher and switch assembly as in claim 1, wherein:

the shaft has an intermediate annular groove for retaining a gasket element.

3. A pusher and switch assembly for an electronic watch having a module assembly and a case with an opening for access to the interior thereof, comprising:

a shaft movably mounted in said opening and having an interior end portion, a spring retainer section having a diameter less than the diameter of the shaft to provide a shoulder for engagement by the spring means, an intermediate annular groove and an actuating end portion;

a switch blade mounted inside the case for axial engagement with the interior end portion of the shaft; and spring means comprising a pair ofseparately protruding substantially U-shaped arms forming an orifice to enable transverse insertion of said spring means into the case between the module assembly and the case for engaging the spring retainer section of the shaft for providing axial movement of the shaft to enable engagement with the switch blade by the interior end portion of the shaft with axial movement of the shaft, and outwardly extending contoured portions to hold said spring means in a mounted position inside the case under spring pressure against the case and the module assembly, said spring means being biased against the case to provide electrical contact between the case and the spring means wherein electrical connection is provided between the case and spring means and shaft.

* * * * *